United States Patent [19]

Henry

[11] 4,388,124

[45] * Jun. 14, 1983

[54] CYCLIC OXIDATION-HOT CORROSION RESISTANT NICKEL-BASE SUPERALLOYS

[75] Inventor: Michael F. Henry, Schenectady, N.Y.

[73] Assignee: General Electric Company, Schenectady, N.Y.

[ * ] Notice: The portion of the term of this patent subsequent to Aug. 18, 1998, has been disclaimed.

[21] Appl. No.: 189,633

[22] Filed: Sep. 22, 1980

Related U.S. Application Data

[63] Continuation-in-part of Ser. No. 34,168, Apr. 27, 1979, abandoned.

[51] Int. Cl.[3] ..... C22C 19/05

[52] U.S. Cl. ..... 148/404; 148/410; 148/428

[58] Field of Search ..... 75/171, 170; 148/32, 148/32.5

[56] References Cited

U.S. PATENT DOCUMENTS

| | | | |
|---|---|---|---|
| 3,526,499 | 9/1970 | Quigg et al. | 75/171 |
| 3,904,402 | 9/1975 | Smashey | 75/171 |
| 4,284,430 | 8/1981 | Henry | 75/171 |

*Primary Examiner*—R. Dean

*Attorney, Agent, or Firm*—Steven S. Strunck; James C. Davis, Jr.; James Magee, Jr.

[57] ABSTRACT

An article of manufacture exhibiting cyclic oxidation-hot corrosion resistant properties comprising a non-eutectic nickel-base superalloy consisting essentially of, on a weight basis, 1–9% Re, 0–2% Ti, at least 2% Al, 3–12% Cr, 1–5.9% Ta, 0–0.5% C, 2–12% Co, 2–10% W, less than 1% V, 2–10% Mo, 0–5% Cb, 0–3% Hf, 0–1.5% Zr and 0–0.20% B, the balance being essentially Ni and incidental impurities. Especially preferred are articles of manufacture in the form of a unidirectionally solidified anisotropic metallic body of the above alloy composition.

16 Claims, 10 Drawing Figures

ALLOY COMPOSITION (WEIGHT %)

| | A | B | C | D |
|---|---|---|---|---|
| Ni | bal. | bal. | bal. | bal. |
| Re | 1.5 | 3.1 | 1.5 | 3.1 |
| Ti | 1.2 | 0.8 | 1.6 | 0.8 |
| Cr | 4.2 | 7.0 | 4.2 | 10.0 |
| Al | 5.8 | 5.8 | 5.8 | 5.8 |
| Ta | 4.5 | 3.0 | 6.0 | 3.0 |
| C | 0.05 | 0.05 | 0.05 | 0.05 |
| Co | 4.1 | 4.1 | 4.1 | 4.1 |
| W | 4.9 | 4.9 | 4.9 | 4.9 |
| V | – | – | – | – |
| Mo | 5.0 | 5.0 | 5.0 | 5.0 |
| Cb | – | – | – | – |
| Hf | 0.5 | 0.5 | 0.5 | 0.5 |
| Zr | – | – | – | – |
| B | 0.015 | 0.015 | 0.015 | 0.015 |

LONGITUDINAL STRESS-RUPTURE DATA
ALLOY "D"
ALLOY "B"
ALLOY "C"
ALLOY "A"
RENÉ 80
APPLIED STRESS - ksi
80
60
40
20
0
42
44
46
48
50
52
54
P=T(20 + log $t_f$) x $10^3$, [°R, hr]
LARSEN - MILLER PARAMETER

ALLOY COMPOSITION (WEIGHT %)

| | E |
|---|---|
| Ni | bal. |
| Re | 3.1 |
| Ti | 0.8 |
| Cr | 4.2 |
| Al | 5.8 |
| Ta | 3.0 |
| C | — |
| Co | 4.1 |
| W | 4.9 |
| V | — |
| Mo | 5.0 |
| Cb | — |
| Hf | — |
| Zr | — |
| B | — |

ALLOY COMPOSITION (WEIGHT %)

| | F |
|---|---|
| Ni | bal |
| Re | 3.1 |
| Ti | 0.8 |
| Cr | 4.2 |
| Al | 5.8 |
| Ta | 3.0 |
| C | 0.05 |
| Co | 4.1 |
| W | 4.9 |
| V | — |
| Mo | 5.0 |
| Cb | — |
| Hf | 0.5 |
| Zr | — |
| B | 0.015 |

CYCLIC OXIDATION-HOT CORROSION RESISTANT NICKEL-BASE SUPERALLOYS

This application is a continuation-in-part of application Ser. No. 034,168, filed Apr. 27, 1979, and now abandoned.

CROSS REFERENCE TO RELATED APPLICATIONS

This invention is related to copending U.S. patent application Ser. Nos. 34,154, filed Apr. 27, 1979 of M. F. Henry, now U.S. Pat. No. 4,284,430, and 34,167, of M. F. X. Gigliotti et al., filed Apr. 27, 1979, now U.S. Pat. No. 4,292,076. The aforesaid applications, now U.S. patents, are assigned to the same assignee as the assignee of this application and all the disclosures contained therein are hereby incorporated herein in their entirety by reference.

BACKGROUND OF THE INVENTION

1. Field of the Invention

This invention relates to an article of manufacture exhibiting cyclic oxidation-hot corrosion resistant properties comprising a non-eutectic nickel-base superalloy having a microstructure substantially free of carbides in the form of aligned fibers consisting essentially of, on a weight basis, 1–9% Re, 0–2% Ti, at least 2% Al, 3–12% Cr, 1–5.9% Ta, 0–0.5% C, 2–12% Co, 2–10% W, less than 1% V, 2–10% Mo, 0–5% Cb, 0–3% Hf, 0–1.5% Zr and 0–0.20% B, the balance being essentially Ni and incidental impurities.

2. Description of the Prior Art

Quigg et al. U.S. Pat. No. 3,526,499 issued Sept. 1, 1970 (filed Aug. 22, 1967) broadly describes nickel-base alloys containing substantial amounts of solid solution strengtheners. Quigg teaches the balanced use of tantalum, tungsten, and molybdenum in order to achieve strength properties without depreciating the oxidation resistance properties of Quigg's alloys. Quigg, however, failed to recognize the exceptional cyclic oxidation-hot corrosion resistant properties associated with nickel-base alloys containing on a weight percent basis, less than 6.0% w/o tantalum and at least 1.0% w/o rhenium, especially nickel-base alloys containing at least 4.0% w/o molybdenum.

Smashey's U.S. Pat. No. 3,904,402, issued Sept. 9, 1975 (filed June 1, 1973) broadly describes eutectic nickel-base alloys containing rhenium and a carbide reinforcing fiber phase exhibiting improved high temperature strength stress rupture properties. Smashey teaches the use of 4–7% w/o vanadium for enhancement of carbide fiber as well as matrix strengthening. Smashey teaches the limited use of molybdenum, i.e. up to about 3% w/o, however preferably omits the use of Mo. Smashey also preferably limits tungsten to about 2–4% w/o in nickel-base superalloys. Smashey summarily teaches the additive use of vanadium and the restrictive use of molybdenum and tungsten. Recent evaluations of Smashey's eutectic alloys has illuminated their generally limiting brittle (non-ductile) transverse strength characteristics.

More recently, interdependent relationships of various alloying elements, e.g. vanadium, molybdenum and tungsten, relative to transverse ductility, cyclic oxidation resistant and hot corrosion resistant eutectic nickel-base alloys containing rhenium and a carbide reinforcing fiber phase have been recognized and are described in M. F. Henry's eutectic nickel-base superalloy invention U.S. Ser. No. 34,154, now U.S. Pat. No. 4,284,430.

Although Henry's Ser. No. 34,154 eutectic nickel-base Re containing carbide fiber reinforced superalloys have improved properties over Smashey's alloys, heretofore non-eutectic nickel-base Re containing superalloys exhibiting significant and substantial cyclic oxidation as well as hot corrosion resistant properties have remained undefined.

DESCRIPTION OF THE INVENTION

This invention embodies an article of manufacture exhibiting cyclic oxidation-hot corrosion resistant properties comprising a non-eutectic nickel-base superalloy consisting essentially of, on a weight basis, 1–9% Re, 0–2% Ti, at least 2% Al, 3–12% Cr, 1–5.9% Ta, 0–0.5% C, 2–12% Co, 2–10% W, less than 1% V, 2–10% Mo, 0–5% Cb, 0–3% Hf, 0–1.5% Zr and 0–0.20% B, the balance being essentially Ni and incidental impurities. Especially preferred are articles of manufacture in the form of a unidirectionally solidified anisotropic body of the above alloy composition.

TABLE I

| Hours of Cycling | Weight Change (mg./cm.$^2$) Alloy "A" | Alloy "B" | Alloy "C" | Alloy "D" | Rene 80 |
|---|---|---|---|---|---|
| 0 | — | — | — | — | — |
| 24 | +0.4 | +0.2 | +0.6 | +0.3 | +2.9 |
| 48 | +0.4 | +0.1 | +0.7 | +0.4 | +0.3 |
| 101 | −0.2 | −0.1 | −0.5 | −0.2 | −31.1 |
| 195 | +0.4 | +0.2 | +0.7 | +0.4 | −145.0 |
| 332 | +0.3 | +0.1 | +0.3 | +0.2 | * |
| 432 | +0.7 | +0.8 | +0.7 | −1.3 | |
| 538 | +0.3 | −0.2 | 0 | −3.0 | |
| 679 | +0.4 | +0.4 | −0.7 | −4.1 | |
| 749 | +0.2 | +0.3 | −1.3 | −5.0 | |
| 851 | +0.3 | +0.3 | −1.6 | −5.4 | |
| 1056 | +0.4 | +0.4 | −2.5 | −6.6 | |

*test discontinued

Figure 1:
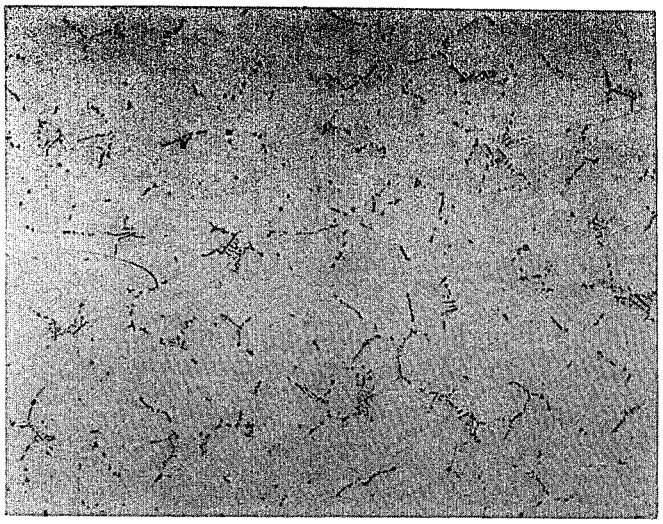
FIG. 1 is a photomicrograph (as polished 125X) of a transverse section of a unidirectionally solidified (d.s.) nickel-base Re containing superalloy composition containing, on a weight percent basis: 3.1 Re, 0.8 Ti, 4.2 Cr, 5.8 Al, 3.0 Ta, 0.05 C, 4.1 Co, 4.9 W, 5.0 Mo, 0.5 Hf, 0.015 B, and the balance Ni.
Figure 2:
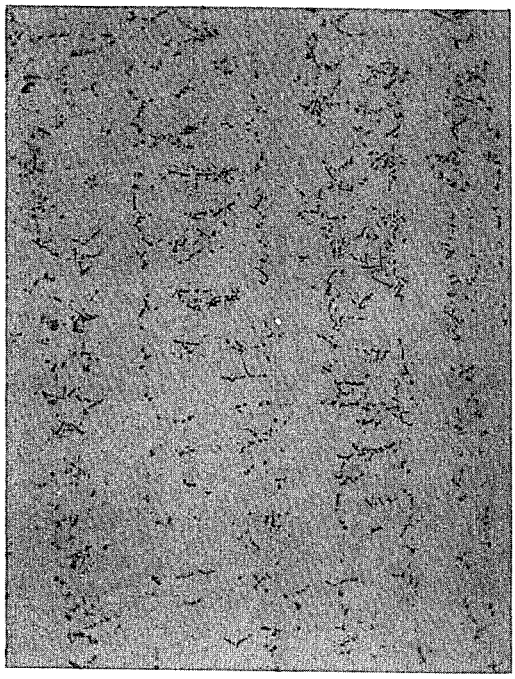
FIGS. 2, 3 and 4 are photomicrographs (as polished 125X, etched 120X, etched 10,000X) of a longitudinal section of the d.s. alloy of FIG. 1.
Figure 3:
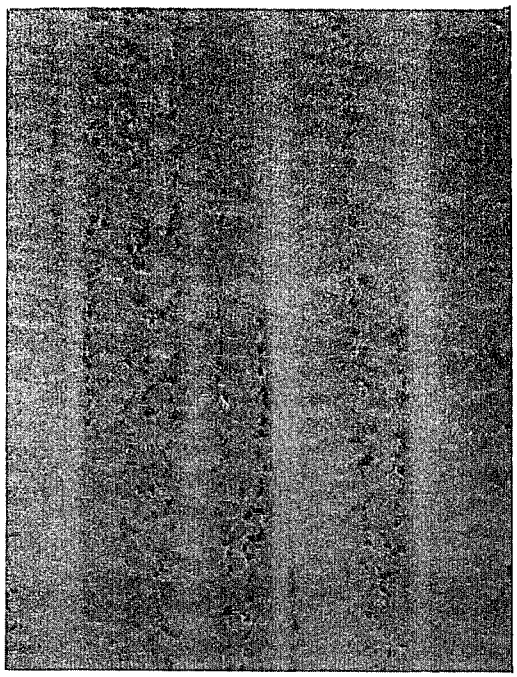
Figure 4:
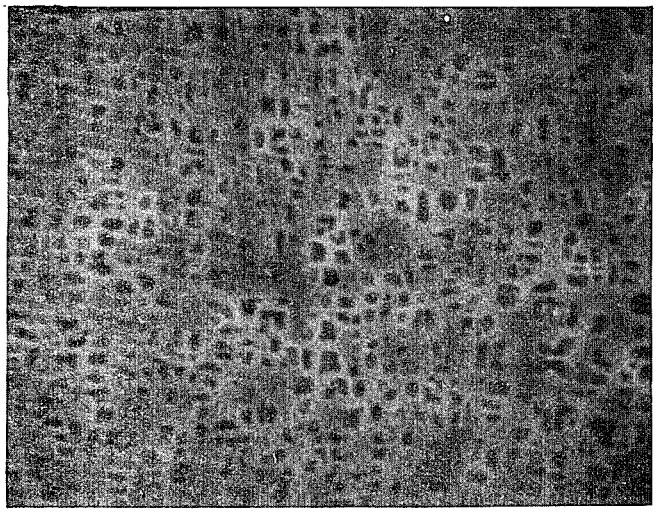
Figure 5:
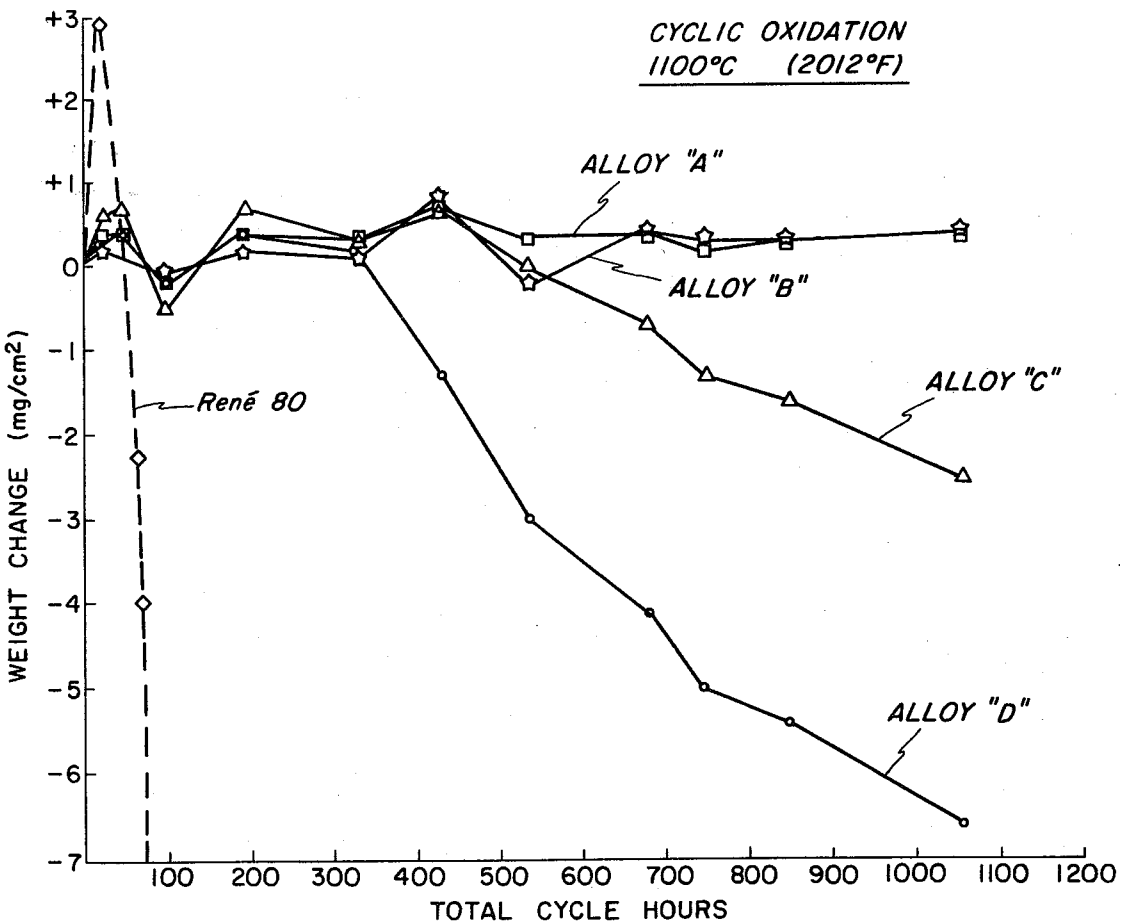
FIG. 5 is a graphical representation of the cyclic oxidation resistance of Rene 80 and a series of unidirectional solidified nickel-base Re containing superalloy compositions of this invention containing, on a weight percent basis, e.g. 1.5 Re, 1.2 Ti, 4.2 Cr, 5.8 Al, 4.5 Ta, 0.05 C, 4.1 Co, 4.9 W, 5.0 Mo, 0.5 Hf, 0.015 B, and the balance Ni, i.e. alloy "A". The data represented in FIG. 5 is based on cyclic oxidation of alloy pin specimens, approximately 4.4 cm. long and 0.25 cm. (0.1") in diameter cycled once per hour in an oxidation cycle consisting of approximately 10 minutes heating, 40 minutes at 1100° C. (2012° F.), and 10 minutes cooling in air at room temperature. Set out in Table I hereinafter is the cyclic oxidation weight change data which forms the basis for FIG. 5.
Figure 6:
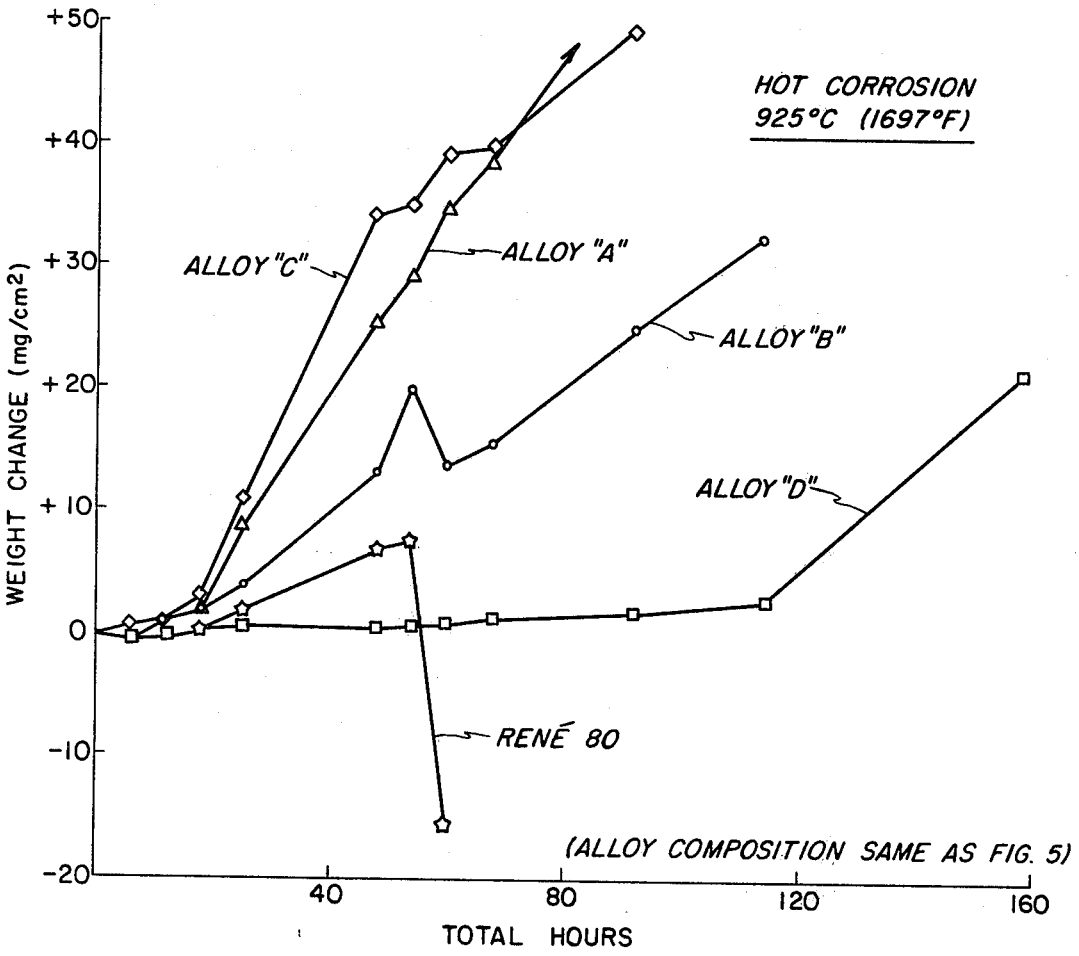

FIG. 6 is a graphical representation of the hot corrosion resistance of Rene 80 and a series of unidirectionally solidified nickel-base Re containing superalloys of the compositions of FIG. 5. The data represented in FIG. 6 is based on hot corrosion testing of alloy pin specimens, about 4.4 cm. long and 0.25 cm. in diameter, subjected to a burner rig test which simulates conditions used in marine gas turbine engine operations under highly corrosive conditions. The hot corrosion test was carried out using a diesel fuel containing 1% by weight of sulfur and 460 parts per million of sea salt at a temperature of 925° C. (1697° F.) coupled with thermocycling to room temperature 3–5 times per day for periodic weight change measurements and visual examination. Set out in Table II hereafter is the hot corrosion weight change data which forms the basis for FIG. 6.

TABLE II

| Hours of Testing | Weight Change (mg./cm.$^2$) Alloy "A" | Alloy "B" | Alloy "C" | Alloy "D" | Rene 80 |
|---|---|---|---|---|---|
| 0 | — | — | — | — | — |
| 6 | +0.4 | +0.3 | −0.2 | −0.4 | −0.1 |
| 12 | +0.9 | +1.0 | +0.8 | −0.2 | −0.1 |
| 18 | +1.9 | +1.9 | +3.2 | 0 | 0 |
| 25 | +8.7 | +3.8 | +10.7 | +0.5 | +1.7 |
| 48 | +25.3 | +13.0 | +34.2 | +0.4 | +6.8 |
| 54 | +29.1 | +19.9 | +35.0 | +0.7 | +7.4 |
| 60 | +34.7 | +13.5 | +39.1 | +0.9 | −15.5 |
| 68 | +28.9 | +15.4 | +39.7 | +1.3 | * |
| 92 | +70.7 | +24.9 | +49.4 | +1.9 | |
| 114 | +74.7 | +32.5 | +58.4 | +2.9 | |
| 158 | * | * | * | +21.8 | |

*test discontinued

Figure 7:
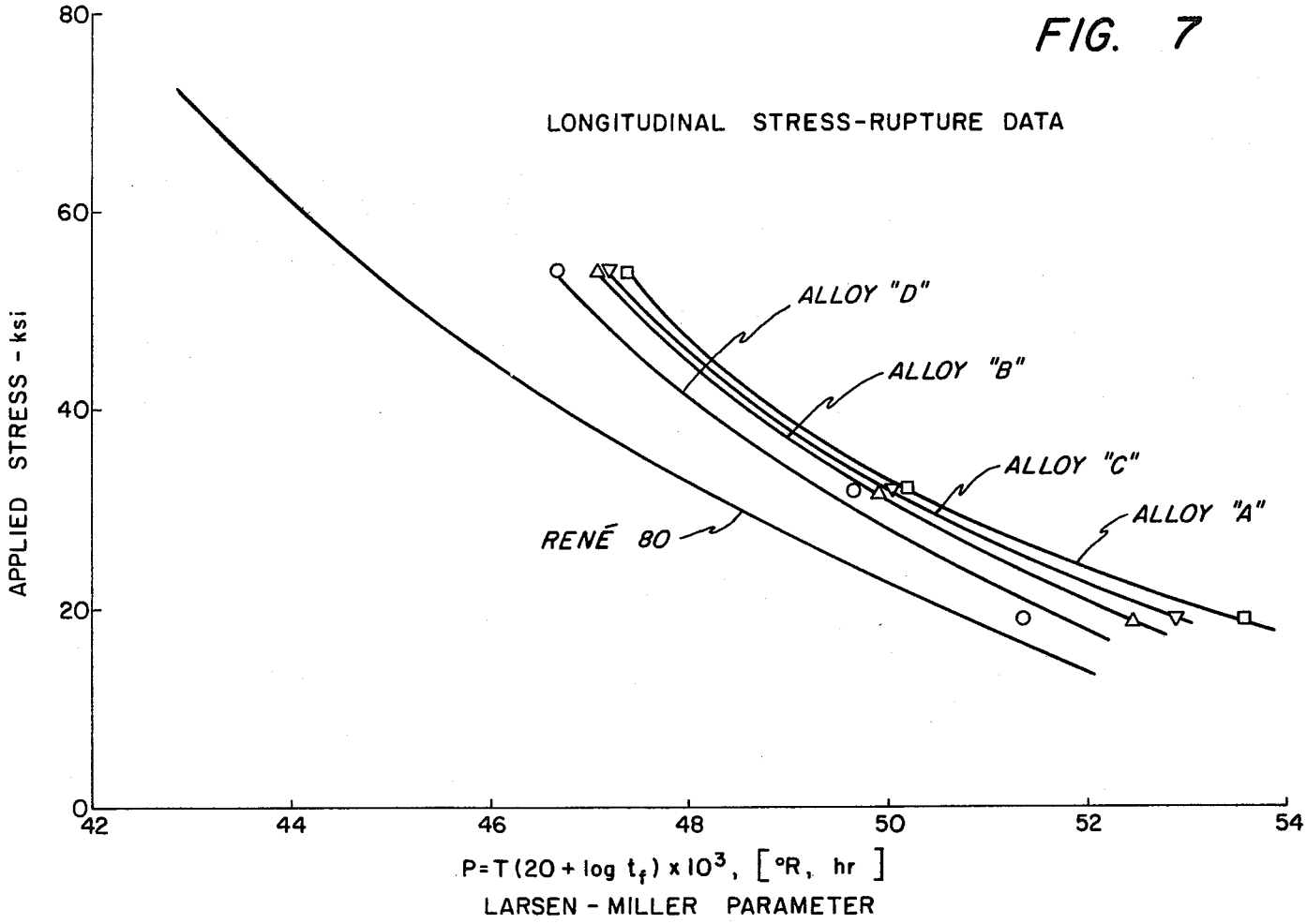

FIG. 7 is a graphical representation of the Larson-Miller parameters of the Alloys A, B, C and D of this invention comparing their alloy strength to that of superalloy Rene 80.

Figure 8:
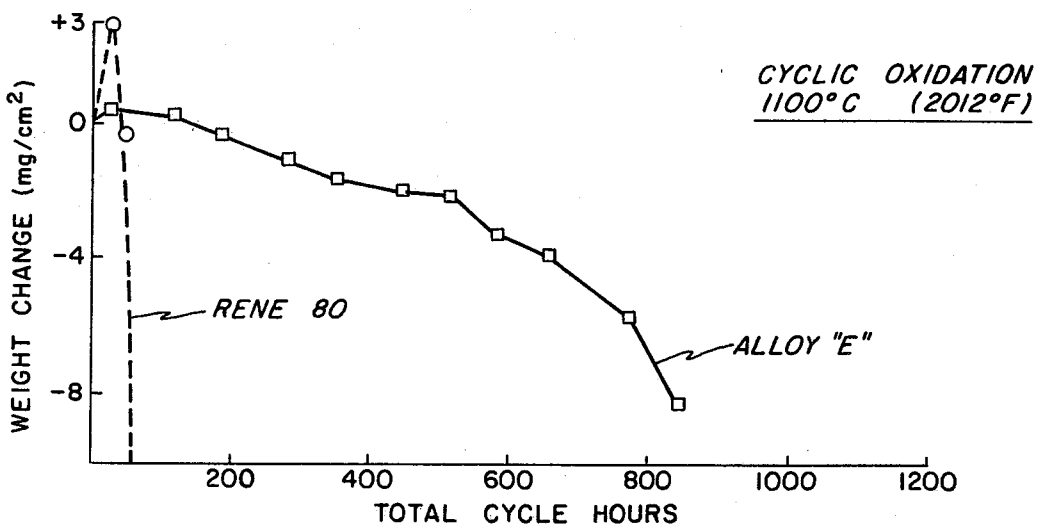

FIG. 8 is a graphical representation of the cyclic oxidation resistance of Rene 80 and a nickel-base superalloy of this invention free of hafnium or boron. This graph illustrates that the excellent cyclic oxidation properties of the alloys of this invention are not related to the presence of hafnium or boron. The alloys were tested in the same manner as the alloys in FIG. 5.

Figure 9:
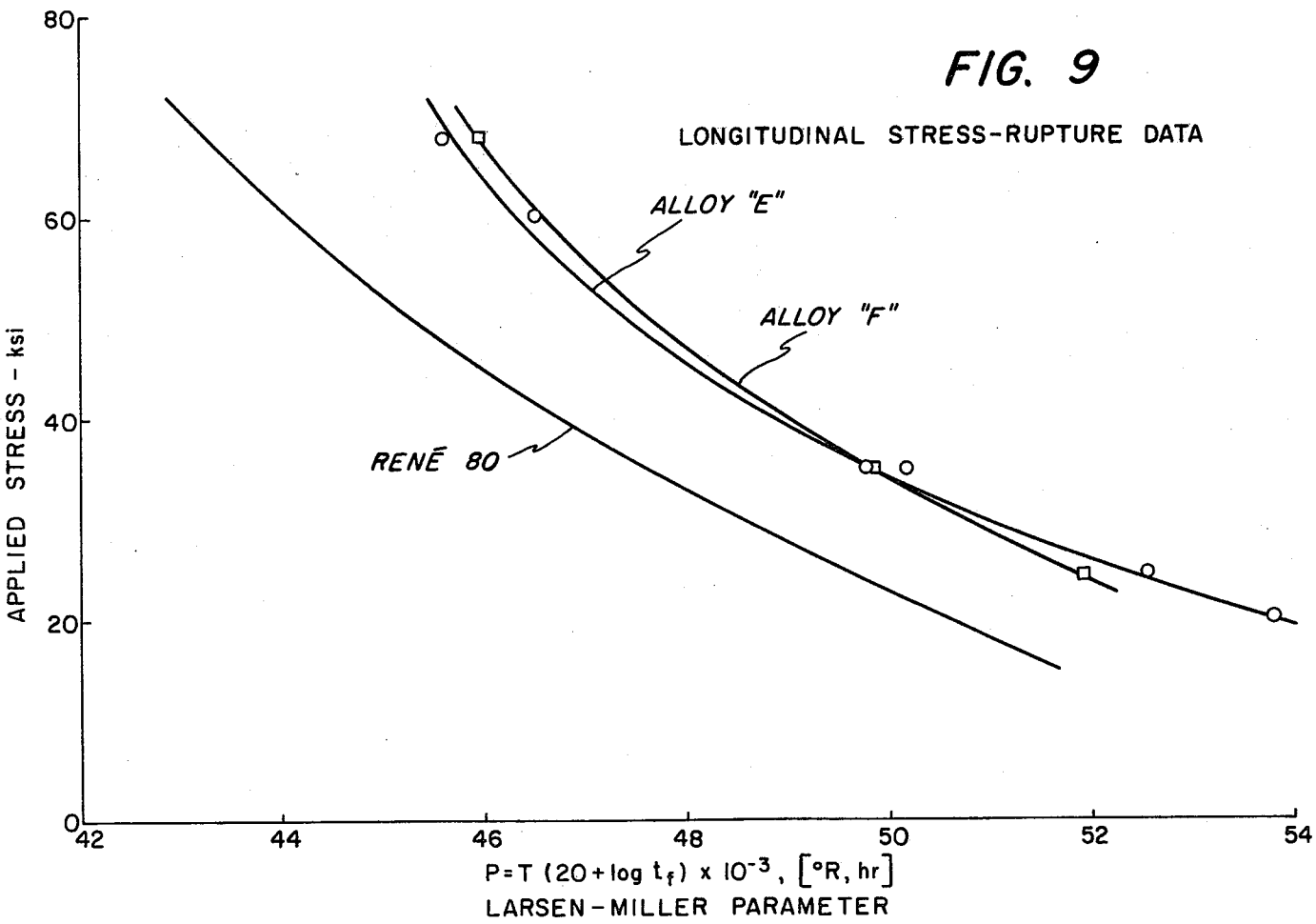

FIG. 9 is an additional graphical representation of the Larson-Miller parameters of alloys free of hafnium or boron of this invention comparing the alloy strength with superalloy Rene 80.

Figure 10:
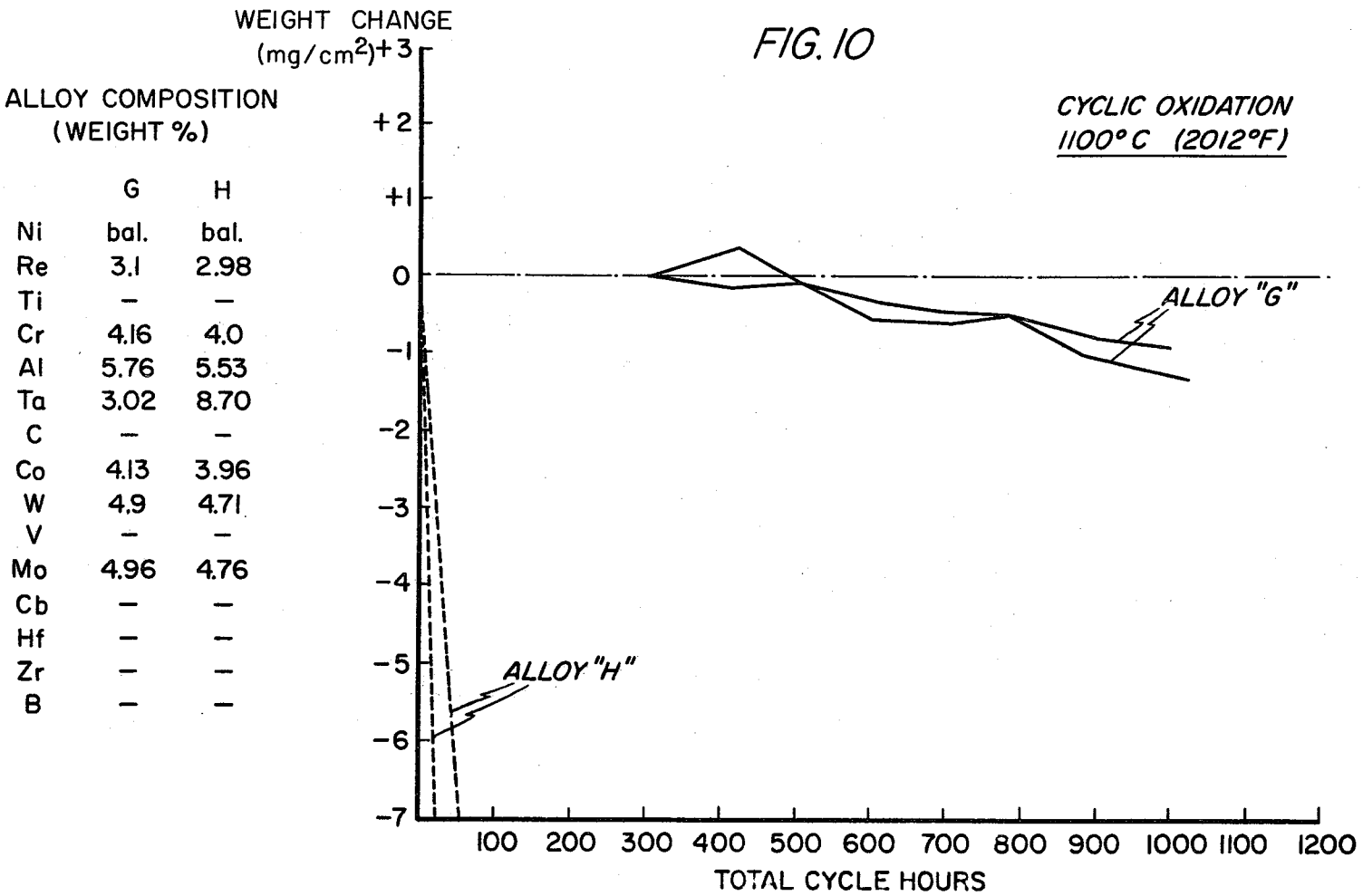

FIG. 10 is a graphical representation of the cyclic oxidation resistance of a unidirectionally solidified nickel-base rhenium containing superalloy composition of this invention containing on a weight percent basis, e.g. 3.1 Re, 4.16 Cr, 5.76 Al, 3.02 Ta, 4.13 Co, 4.9 W, 4.96 Mo, and the balance nickel, i.e. alloy "G", and a unidirectionally solidified nickel-base rhenium containing superalloy composition not of this invention containing on a weight percent basis, e.g. 2.98 Re, 4.0 Cr, 5.53 Al, 8.70 Ta, 3.96 Co, 4.71 W, 4.76 Mo, and the balance nickel, i.e. alloy "H". The significant difference between the alloys "G" and "H" is that alloy G contains tantalum in amounts, i.e. 3 weight percent, which is within the scope of the alloys of this invention whereas the alloy "H" contains tantalum in amounts, i.e. 8.7 weight percent, outside the scope of this invention, however, within the scope of the alloys of Quigg's teachings in U.S. Pat. No. 3,526,499.

FIG. 10 illustrates that the excellent cyclic oxidation properties associated with the alloys of this invention can be deleteriously affected by the presence of tantalum when tatalum is present in an amount, i.e. 8.7 weight percent, an amount typical of the amounts used in Quigg's specific and general alloy compositions.

In general, presently preferred alloy compositions of this invention, on a weight percent basis, are as follows:

| Elements | Alloy Compositions Base | Preferred | More Preferred |
|---|---|---|---|
| Ni | bal. | bal. | bal. |
| Re | 1–9 | 1–4 | 1–4 |
| Ti | 0–2 | 0.4–2.0 | 0.5–2.0 |
| Cr | 3–12 | 3–12 | 3–12 |
| Al | ≧2 | 5–7 | 5–7 |
| Ta | 1–5.9 | 1.5–5.75 | 1.5–5.5 |
| C | 0–0.5 | 0–0.1 | 0–0.1 |
| Co | 2–12 | 3–5 | 3–5 |
| W | 2–10 | 4–6 | 4–6 |
| V | 0–1 | 0–0.5 | 0–0.2 |
| Mo | 2–10 | 4–6 | 4–6 |
| Cb | 0–5 | 0–3 | 0–3 |
| Hf | 0–3 | 0–1.5 | 0–1 |
| Zr | 0–1.5 | 0–1 | 0–0.5 |
| B | 0–0.20 | 0–0.20 | 0–0.20 |

As used herein and in the appended claims, an article of manufacture of this invention includes—however, is not limited to—a unidirectionally solidified anisotropic metallic body comprising a Ni-base superalloy containing a gamma/gamma-prime matrix wherein the matrix contains a solid solution gamma phase and an ordered equiaxed precipitate strengthened gamma-prime phase.

Based on the Figures, Tables and Alloy Compositions set out herein, variations in the alloy compositions—without departing from the concept of significant and substantial cyclic oxidation-hot corrosion resistant Re containing nickel-base superalloys—will be apparent to those skilled in the art.

I claim:

1. An article of manufacture exhibiting cyclic oxidation-hot corrosion resistant properties comprising a non-eutectic nickel-base superalloy having a microstructure substantially free of carbides in the form of aligned fibers consisting essentially of, on a weight basis, 1–9% Re, 0–2% Ti, at least 2% Al, 3–12% Cr, 1–5.9% Ta, 0–0.5% C, 2–12% Co, 2–10% W, less than 1% V, 2–10% Mo, 0–5% Cb, 0–3% Hf, 0–1.5% Zr and 0–0.20% B, the balance being essentially Ni and incidental impurities.

2. The claim 1 article wherein the superalloy consists essentially of about, on a weight basis, 1–4% Re, 0.4–2.0% Ti, 5–7% Al, 3–12% Cr, 1.5–5.75% Ta, 0–0.1% C, 3–5% Co, 4–6% W, 0–0.5% V, 4–6% Mo, 0–3% Cb, 0–1.5% Hf, 0–1.0% Zr, 0–0.20% B, the balance being essentially Ni and incidental impurities.

3. The claim 2 article wherein the superalloy consists essentially of about, on a weight basis, 1–4% Re, 0.5–2.0% Ti, 5–7% Al, 3–12% Cr, 1.5–5.5% Ta, 0–0.1% C, 3–5% Co, 4–6% W, 0–0.2% V, 4–6% Mo, 0–3% Cb, 0–1% Hf, 0–0.5% Zr, 0–0.20% B, the balance being essentially Ni and incidental impurities.

4. An article of manufacture exhibiting cyclic oxidation-hot corrosion resistant properties comprising a non-eutectic nickel-base superalloy having a microstructure substantially free of carbides in the form of aligned fibers consisting essentially of about, on a weight basis, 1–4% Re, 0.5–1.75% Ti, 5–7% Al, 3–8% Cr, 2–5.5% Ta, 0–0.1% C, 3–5% Co, 4–6% W, 0–0.2% V, 4–6% Mo, 0.0–1% Hf, 0–0.5% Zr, 0–0.20% B, the balance being essentially Ni and incidental impurities.

5. The claim 4 article wherein the superalloy is a nickel-base superalloy consisting essentially of about, on a weight basis, 1.5% Re, 1.2% Ti, 5.8% Al, 4.2% Cr, 4.5% Ta, 0.05% C, 4.1% Co, 4.9% W, 5.0% Mo, 0.5% Hf, 0.015% B, the balance being essentially Ni and incidental impurities.

6. The claim 4 article, wherein the superalloy is a nickel-base superalloy consisting essentially of about, on a weight basis, 3.1% Re, 0.8% Ti, 5.8% Al, 7.0% Cr, 3.0% Ta, 0.05% C, 4.1% Co, 4.9% W, 5.0% Mo, 0.5% Hf, 0.015% B, the balance being essentially Ni and incidental impurities.

7. The claim 1 article wherein the superalloy is a nickel-base superalloy consisting essentially of about, on a weight basis, 1.5% Re, 1.6% Ti, 5.8% Al, 4.2% Cr, 5.9% Ta, 0.05% C, 4.1% Co, 4.9% W, 5.0% Mo, 0.05% Hf, 0.015% B, the balance being essentially Ni and incidental impurities.

8. The claim 1 article, wherein the superalloy is a nickel-base superalloy consisting essentially of about, on a weight basis, 3.1% Re, 0.8% Ti, 5.8% Al, 10.0% Cr, 3.0% Ta, 0.05% C, 4.1% Co, 4.9% W, 5.0% Mo, 0.5% Hf, 0.015% B, the balance being essentially Ni and incidental impurities.

9. The claim 1 article wherein the article is a unidirectionally solidified anisotropic metallic body.

10. The claim 2 article wherein the article is a unidirectionally solidifed anisotropic metallic body.

11. The claim 3 article wherein the article is a unidirectionally solidified anisotropic metallic body.

12. The claim 4 article wherein the article is a unidirectionally solidifed anisotropic metallic body.

13. The claim 5 article wherein the article is a unidirectionally solidified anisotropic metallic body.

14. The claim 6 article wherein the article is a unidirectionally solidified anisotropic metallic body.

15. The claim 7 article wherein the article is a unidirectionally solidified anisotropic metallic body.

16. The claim 8 article wherein the article is a unidirectionally solidifed anisotropic metallic body.

* * * * *